United States Patent [19]

Braud

[11] Patent Number: 5,075,953

[45] Date of Patent: Dec. 31, 1991

[54] METHOD OF AND APPARATUS FOR STORING PRODUCTS FROM CONTINUOUS CASTING LINES PRIOR TO ROLLING

[75] Inventor: Yves Braud, Maurepas, France

[73] Assignee: Stein-Heurtey, Ris Orangis, France

[21] Appl. No.: 628,153

[22] Filed: Dec. 17, 1990

[30] Foreign Application Priority Data

Dec. 19, 1989 [FR] France ..... 89 16811

[51] Int. Cl.[5] ..... B21B 1/46; B21B 13/22; B22D 11/12

[52] U.S. Cl. ..... 29/527.7; 29/33 C; 72/202

[58] Field of Search ..... 164/417, 476; 29/33 C, 29/527.6, 527.7; 72/200, 202

[56] References Cited

U.S. PATENT DOCUMENTS

| | | | |
|---|---|---|---|
| 4,229,878 | 10/1980 | Ushijima | 29/527.7 |
| 4,829,656 | 5/1989 | Rohde | 29/527.7 |
| 4,918,803 | 4/1990 | DiGiusto | 29/33 C |

FOREIGN PATENT DOCUMENTS

| | | | |
|---|---|---|---|
| 0313726 | 5/1989 | European Pat. Off. . | |
| 0353487 | 2/1990 | European Pat. Off. . | |
| 1216912 | 5/1966 | Fed. Rep. of Germany . | |
| 3708050 | 9/1988 | Fed. Rep. of Germany | 164/417 |
| 54-153750 | 12/1979 | Japan | 29/527.6 |
| 57-121806 | 7/1982 | Japan | 29/527.7 |
| 58-6701 | 1/1983 | Japan | 164/417 |
| 61-176402 | 8/1986 | Japan | 29/527.7 |

*Primary Examiner*—J. Reed Batten, Jr.
*Attorney, Agent, or Firm*—Pollock, VandeSande & Priddy

[57] ABSTRACT

A metallurgical product storage device located downstream from two parallel continuous casting lines and upstream from a rolling line includes: a heated storage chamber having a length at least equal to the length of the products to be stored and having opposite inlets and outlets for the products originating from the continuous casting lines and delivered to the rolling line, these products being displaced in the chamber on tables with rollers disposed, respectively, along the axes of the continuous casting lines; and a storage zone in the chamber located between the two tables with rollers and including movable support beams for supporting the products, capable of being displaced vertically between several levels, and movable transport beams, separated from the support beams and capable of being displaced vertically and horizontally for advancing the products step-by-step according to a series of successive rectangular movements. The beams are installed successively between two rollers of each table with rollers to that the product to be stored corresponding to each continuous casting line can be successively lifted and displaced parallel to this axis by the movable beams in order to be deposited for storage between the two rows of tables and rollers.

5 Claims, 5 Drawing Sheets

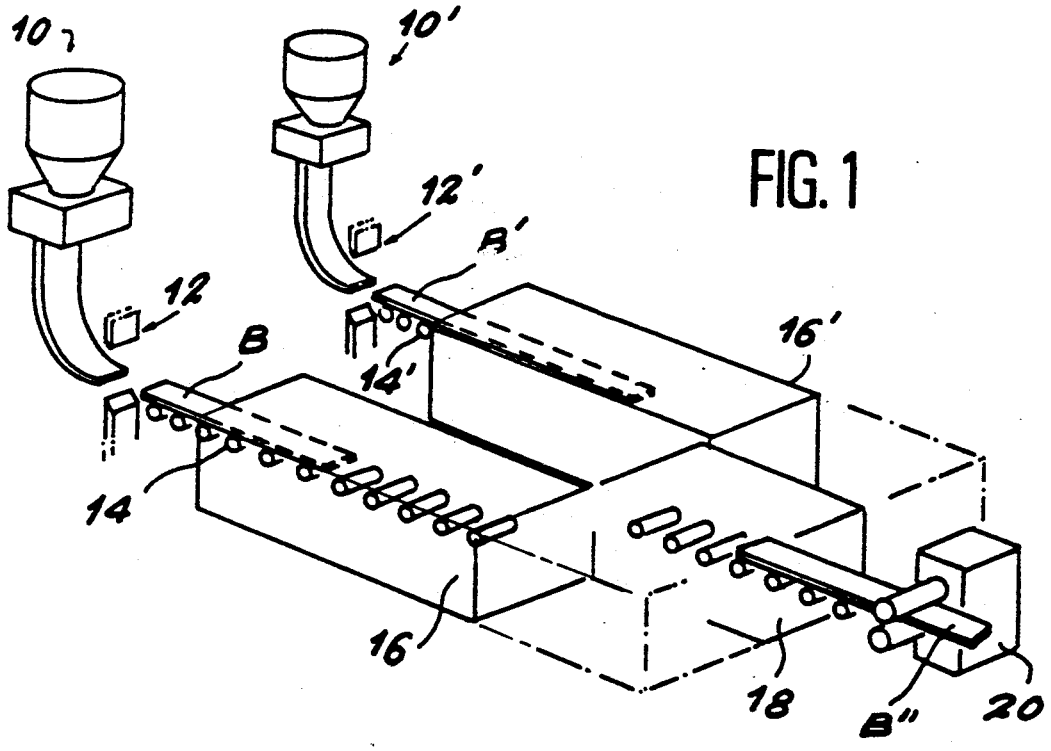
FIG. 1
FIG. 4
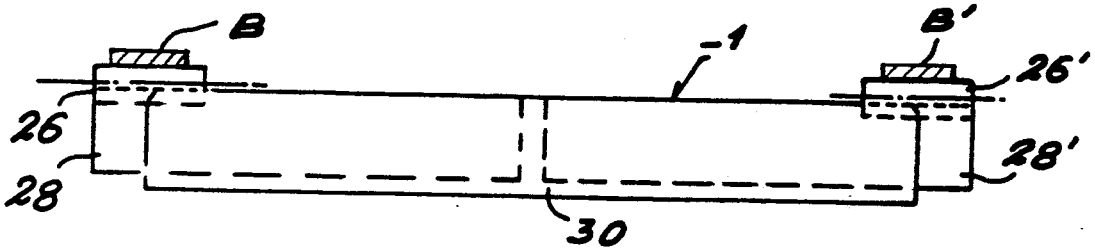
FIG. 5
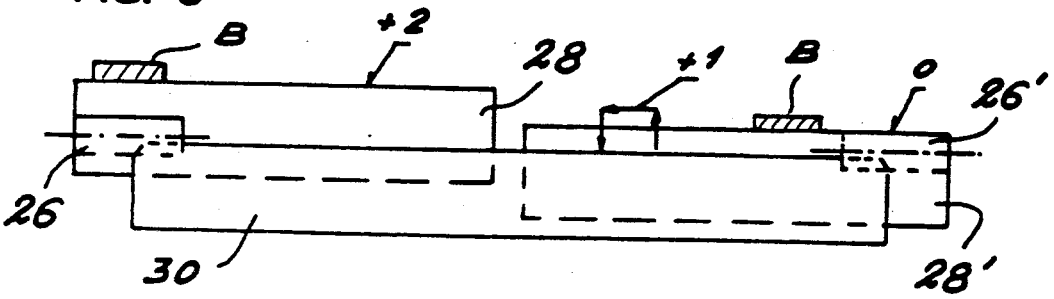

METHOD OF AND APPARATUS FOR STORING PRODUCTS FROM CONTINUOUS CASTING LINES PRIOR TO ROLLING

FIELD OF THE INVENTION

The present invention relates to a device to ensure the storage of metallurgical products, such as, in particular, thin slabs, obtained from parallel continuous casting lines and delivered to a rolling-mill system. More particularly, the invention proposes to provide a device for storage of such metallurgical products which has to be installed downstream of two parallel continuous casting lines functioning simultaneously and upstream of a system for transfer of the products obtained in order to ensure a continuous feed for a rolling mill with the aid of products originating independently and alternately from each continuous casting line.

BACKGROUND OF THE INVENTION

In order to make the technical field to which the present invention applies more easily understood, reference will firstly be made to FIG. 1 of the appended drawings which shows, in perspective and diagrammatically, an installation which comprises two continuous casting lines 10, 10' making it possible to obtain metallurgical products such as thin slabs B, B'. Two shears 12, 12' cut each slab to the desired length, and the slab such as B or B' thus produced is brought into a furnace 16, 16', respectively, by displacement on a table with rollers 14, 14', respectively. Each of the furnaces 16, 16' is disposed according to the corresponding casting axis and it ensures an ideal homogeneous temperature for the slab for the subsequent rolling operation. Inside each of the furnaces, the slabs are displaced on a system of rollers or runners driven in rotation. At the outlet of the furnaces 16, 16', a transfer machine, denoted overall by the reference 18, is provided, which makes it possible to feed a rolling mill 20 with the aid of successive slabs such as B" originating alternately from each continuous casting line 10, 10'.

It is known that continuous casting cannot be slowed down or interrupted without detriment to the quality of the products it makes it possible to obtain. Given that the feed to the furnaces, such as 16, 16', is thus continuous, removal of the metallurgical products, such as the thin slabs B, B', from these furnaces must thus also be ensured in a continuous manner in order to permit optimum functioning of the entire installation. In point of fact, continuous removal of the products from the furnaces, such as 16, 16', cannot be guaranteed in all cases, particularly when the rolling installation such as 20, is stopped for maintenance or in the event of breakdown. It is thus necessary to provide means which make it possible to ensure the storage of the products which correspond to the production of the two continuous casting lines 10, 10', during the period of stoppage of functioning of the rolling installation 20. This is the aim of the device which is the subject of the present invention.

SUMMARY OF THE INVENTION

Consequently, this invention relates to a device which makes it possible to ensure the storage of metallurgical products, such as, in particular, thin slabs, specifically designed to be installed downstream of two parallel continuous casting lines functioning simultaneously and upstream of a system for transfer of the products obtained in order to ensure a continuous feed to a rolling mill with the aid of the products originating alternately and indiscriminately from each continuous casting line, this device comprising:

a heated storage chamber of a length at least equal to the length of products to be stored and comprising opposite inlet and outlet apertures for the products originating from the continuous casting lines, the products being displaced in said storage chamber on tables with rollers, or the equivalent, located respectively along the axes of the continuous casting lines;

a storage zone in said chamber located between the two tables with rollers and comprising movable beams, namely beams for supporting the products capable of being displaced vertically between several levels and transport beams located at a certain distance from the support beams and capable of being displaced vertically and horizontally so as to cause the products to advance step-by-step inside the storage zone according to a rectangular movement, said movable beams being installed successively between two rollers of each table with rollers so that the product to be stored corresponding to each continuous casting line is selectively seized and displaced parallel to its axis by said movable beams in order to be deposited for storage between the two rows of tables with rollers.

According to a preferred embodiment of the present invention, the movable support beams are distributed in two identical series disposed in parallel in two locations of the storage zone and a single series of transport beams is provided, each beam of said series being positioned between two pairs of support beams at one location in the storage zone in order to ensure indepently the displacement of the products originating from one or the other of the continuous casting lines in said storage zone.

According to an alternative embodiment of the present invention, which makes it possible to ensure independent removal of the products stored on each row of respective tables with rollers, each of the transport beams is divided into two independent parts which makes it possible to create two independent storage zones, each zone being fed with products from the corresponding table with rollers.

The invention also relates to an application of the device to the storage and to the transfer of thin products originating from two continuous casting lines parallel to a rolling line, wherein the products penetrate into the storage chamber on one of the tables with rollers of the latter and re-emerge from this chamber by means of the other table with rollers, the products being transferred between said tables with rollers by means of movable beams, it being possible for these products to be stored in the storage zone located between the two tables with rollers.

BRIEF DESCRIPTION OF THE DRAWINGS

Other features and advantages of the present invention will become apparent from the description given below with reference to the appended drawings which show illustrative embodiments and an implementation thereof which are in no way limiting in character. In the drawings:

FIG. 1 is a diagrammatic view in perspective illustrating an installation described above to which the device which is the subject of the invention can be applied;

FIGS. 4 to 9 are diagrammatic views corresponding to FIG. 2 and intended to explain the functioning of the device which is the subject of the present invention according to a first method of implementation;

DETAILED DESCRIPTION OF THE INVENTION

As already specified above, the device according to the present invention essentially comprises a heated chamber in which a storage zone intended to receive the metallurgical products, such as the thin slabs B, B', originating continuously from the two continuous casting lines, such as 10, 10', is provided. This storage chamber according to the invention may be installed either on the inlet side of the two furnaces, such as 16, 16' (FIG. 1) or on the outlet side of these two furnaces, immediately before the transfer device 18 enabling the rolling line 20 to be fed. Of course, the storage chamber according to the invention may be installed in any intermediate position.

According to the present invention, this storage chamber 22 has the form of a furnace having a length which is at least equal to the length of the metallurgical products which are to be stored. This storage chamber 22 comprises inlets, such as 24, 24' ensuring the introduction in the chamber of the products, such as thin slabs, originating from the continuous casting lines and it also comprises outlet apertures for these products, the latter having to be transferred to a rolling installation.

Figure 2:
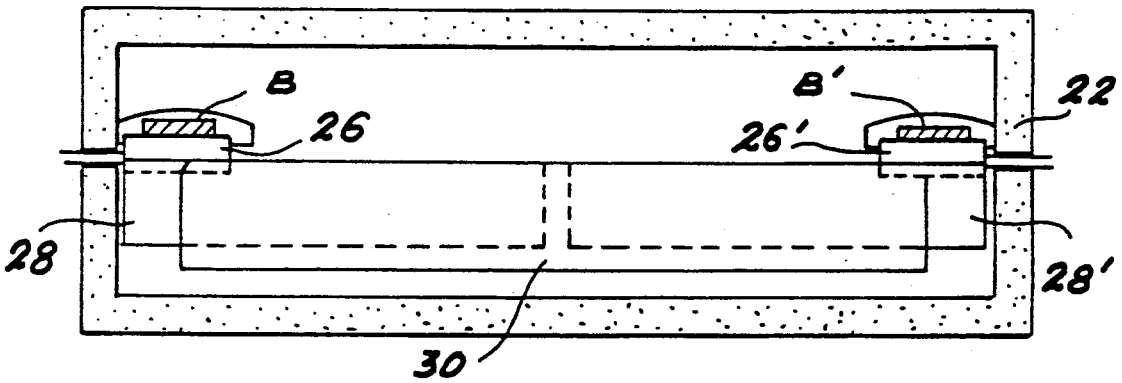
FIG. 2 is a diagrammatic view in transverse section of the storage chamber which is the subject of the present invention.

The transport of the thin slabs inside the storage chamber is ensured with the aid of support and drive rollers such as 26, 26', it being possible for the driving in rotation of these rollers to be provided from the outside of the storage chamber by means of a projecting shaft, as shown in FIG. 2.

At each step, between two rollers, such as 26 or 26', movable beams, such as 28, 28' and 30, are provided. These movable beams and their displacement are designed so as to displace the products such as the thin slabs B, B', inside the storage chamber 22, parallel to their axes, from the two rows which correspond to the axes of the continuous casting lines, such as 10, 10', and to deposit them for storage in a storage zone which is provided between the two lines of tables with rollers 26, 26'.

The movable beams 28, 28' are devices for supporting the products and the movable beams, such as 30, are devices for transporting the products. These support and transport beams can be displaced in the vertical direction relative to the lines of rollers 26, 26' so as to pass from a position of maximum elevation, in which the upper surface of the beams is located at an upper level relative to the lines of rollers 26, 26', to a position of minimum elevation, in which the upper surface of these beams is located at a lower level relative to the lines of rollers.

Figure 3:
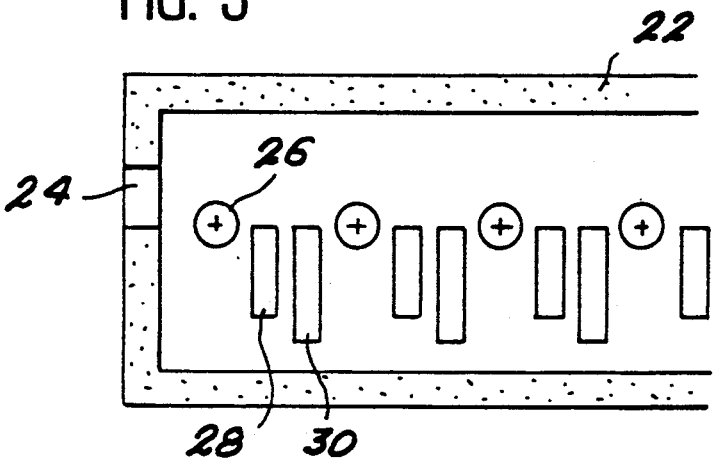
FIG. 3 is a longitudinal section of FIG. 2.

The transport beams, such as 30, are located at a certain distance from the support beams 28, as may be seen in FIG. 3, and they can be raised relative to these support beams, while also being capable of being displaced horizontally in order to cause the products to advance step by step. As will be seen below, each metallurgical product, such as the thin slabs B, B', corresponding to each row is grasped selectively by virtue of the relative movement of the support beams 28, 28' and the transport beams 30. When operating conditions permit, the movable transport and support beams ensure the displacement of the products waiting in the storage zone located between the tables with rollers, 26, 26' towards the normal operating circuit. A storage capacity is thus produced which makes it possible to proceed with continuous casting in the event of even a prolonged stoppage of the work of the rolling line.

Reference is now made to FIGS. 4 to 9 which illustrate a first mode of functioning of the device according to the present invention.

FIG. 4 shows diagrammatically the installation during normal functioning, the thin slabs B, B' passing continuously over the tables with rollers 26, 26' located in the chamber of the storage chamber 22 according to the axes of the, continuous casting lines. In this phase of functioning, the movable support beams 28, 28' and transport beams 30 are located at a level referenced −1, the level reference 0 being that of the upper plane of the tables with rollers 26, 26'.

FIG. 5 shows the start of a cycle of taking the product for storage, the aim of this cycle being to bring a product B' into the storage zone located between the two tables with rollers 26, 26'. The support beam 28 displaces the product B vertically up to the level referenced +2, thus the product B which previously rested on the table with rollers 26 will remain stationary regardless of the subsequent movements of the other movable beams, given that its height (level +2) keeps it out of reach of the moving beams. The other support beam 28' vertically displaces the product B' until it is in the upper plane of the rollers of the tables with rollers 26, 26' (level referenced 0). Next, the movable transport beam 30 ensures a displacement of the product B' according to a step-by-step movement:

vertical displacement of the product B' up to the level +1;

horizontal displacement of the product B' towards the storage zone located between the two tables with rollers 26, 26'; and vertical displacement of the product B' up to the level 0 and placing of this product on the support beams 28'.

It will be noted that the horizontal displacement of the product, such as B', may be obtained in a single operation or by the repetition of several identical rectangular cycles so as to bring the product to be stored into any desired location of the storage zone located between the two tables with rollers 26, 26'.

Figure 6:
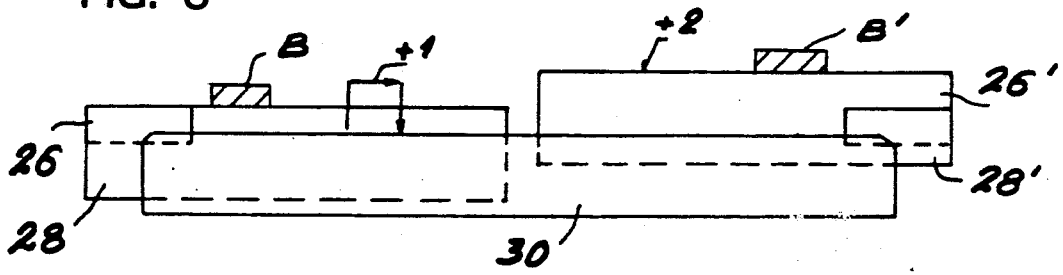

Reference is now made to FIG. 6 which illustrates the manner in which the storage of the product B is performed.

The product B' is placed on the beams 28, 28' at the height level +2 so as to make it possible to perform freely the transfer cycle of the product B, the product B' thus being placed out of reach of the various elements which perform the displacement of the product B towards the storage zone. In the manner described above with reference to FIG. 5, the beams 28 firstly place the product B in the plane of the rollers 26 at the level 0, then the beams 30 perform one or more rectangular cycles so as to bring the product B into a storage position. This cycle of storage of the product B proceeds in the same manner as the cycle of storage of the product B' described above with reference to FIG. 5.

Figure 7:
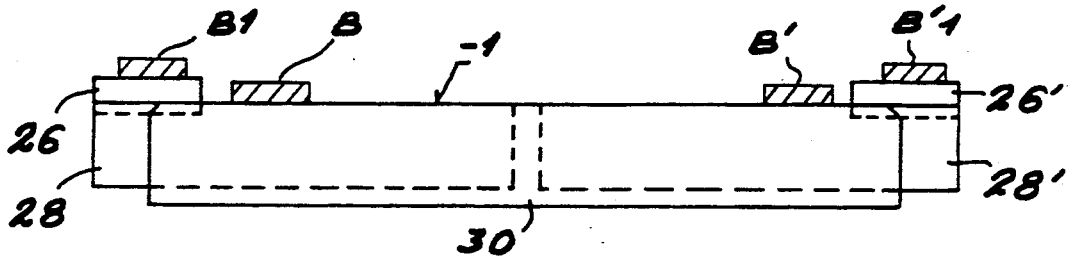

FIG. 7 shows the operation of storage of the products B and B' on the movable beams 28, 28' and 30 at the level −1. In this storage position, the rollers 26, 26' are free and they can directly transfer other products, such as B1, B'1, according to each of the axes of the tables with rollers. The products B and B' remain in the storage zone and the vertical movements of the movable support beams 28, 28' and transport beams 30 make it possible to vary the point of support of the product and consequently to limit the hot deformation of the latter, as well as the formation of black marks.

Figure 8:
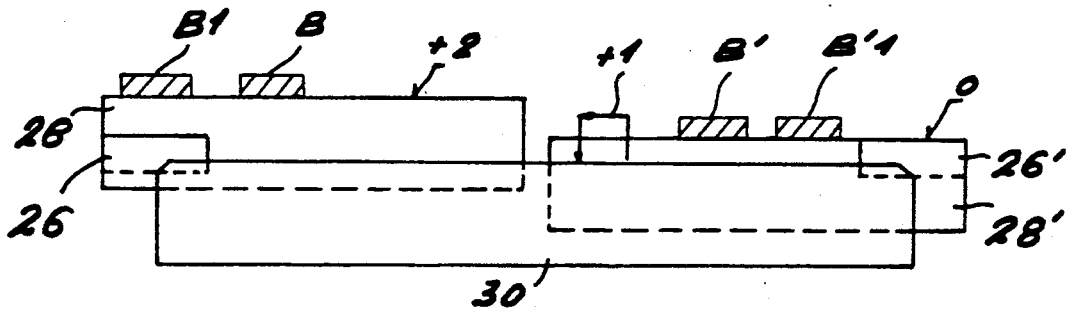

FIG. 8 shows the seizing of a second product B'1 on the table with rollers 26'. This cycle will proceed in the manner described previously: it is commenced by ensuring a removal of the products B and B1 to the level +2 so as to place them out of reach of the movable elements which are employed to ensure the displacement of the products B' and B'1 towards the storage zone, and then the displacement of the support beams 28' is ensured by raising up to the level 0, then a horizontal displacement of the two products B' and B'1 is performed by virtue of the transport beams 30 which perform one or more rectangular cycles in the manner described above. The products B' and B'1 have thus been brought into two successive locations in the storage zone. Of course, a similar operation may be performed on the other side of the installation, that is to say on the side of the table with rollers 26, in order to displace the products B and B1 towards the storage zone.

Figure 9:
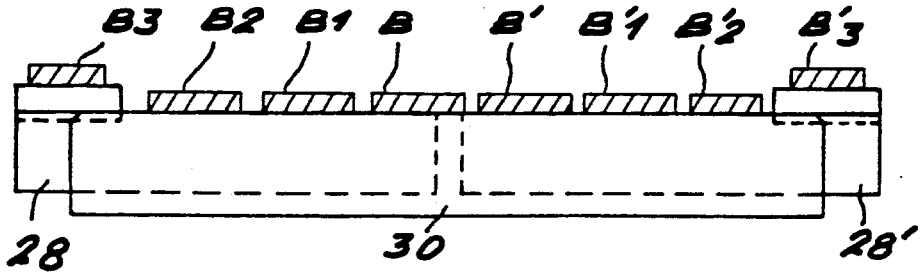

FIG. 9 shows an example of maximum storage capacity of eight products. In this configuration, the storage zone comprises two lots of three products B, B1, B2 and B', B'1, B'2, respectively, originating respectively from each of the continuous casting lines and two products B3, B'3 waiting on the tables with rollers 26, 26' of the storage furnace according to the present invention.

A description will now be given of the manner in which the products are removed.

After a storage operation, the configuration may be that illustrated in FIG. 7, according to which two products B, B' have been positioned in the storage zone, up to the configuration illustrated in FIG. 9, in which there are six products present in the storage zone. In all cases, the mode of implementation of the invention to ensure the removal of the products with the aid of the tables with rollers 26, 26' will be identical.

The removal of the products commences with the products which are present on the tables with rollers 26, 26', these products following the usual transfer cycle. When a table with rollers located opposite the storage zone is free, the stored products corresponding to the other continuous casting row are placed out of reach of the movable elements employed to ensure the removal of a product on said table with rollers, using the movable beams 28, 28' and 30 so as to bring the products to be isolated to the level +2, as shown, for example, in FIG. 8 (left-hand part). Then the cycle which is the reverse of that described above in the case of storage is performed, in order to effect the displacement and the deposition of the product to be removed on the table with rollers. This cycle is performed by means of a lifting movement obtained with the aid of the support beams, such as 28, 28', and by a rectangular movement of the transport beams 30. After its deposition on the table with rollers in question, the product thus removed from storage is removed into the normal circuit as indicated above. This operation can take place in an identical manner for each subsequent product present in the storage zone until this zone is totally emptied and normal manufacture resumes, that is to say a passage of the product directly through the storage furnace on the tables with rollers 26, 26' towards the corresponding removal outlets.

Reference is now made to FIGS. 10 to 14 which illustrate an alternative embodiment of the device according to this invention.

This alternative embodiment is essentially different from the embodiment described above with reference to FIGS. 4 to 9, in that the movable transport beams are distributed in pairs 30, 30' between the support beams 28, 28'. This configuration makes it possible to perform a storage of products, such as B, B', from one or the other of the tables with rollers 26, 26' disposed according to the axes of the two continuous casting lines, this storage being performed totally independently for the two lines. Thus, two independent storage zones S1 and S2 are obtained, receiving, respectively, the products to be stored, such as B, B', which originate from the respective tables with rollers 26, 26'. It is thus possible to store a product in one of the zones while a product is being loaded on the rollers corresponding to the other storage zone.

Reference is now made to FIGS. 11 to 14 which illustrate the storage of the products in the case of this alternative embodiment with the aid of diagrams which correspond to the diagrams in FIGS. 4 to 9.

Figure 10:
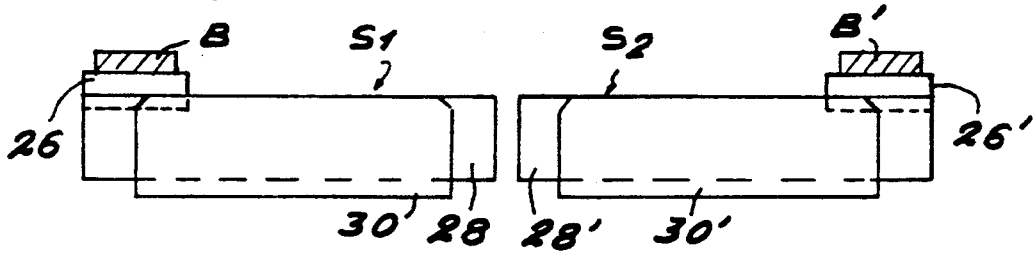
FIGS. 10 to 14 are diagrammatic views, similar to FIGS. 4 to 9, illustrating an alternative embodiment of the device according to the invention.

FIG. 10 shows the departure phase. In the situation thus illustrated, a product B is passing over the table with rollers 26 and a product B', which it is now desired to store in the storage zone S2 is present on the table with rollers 26'.

Figure 11:
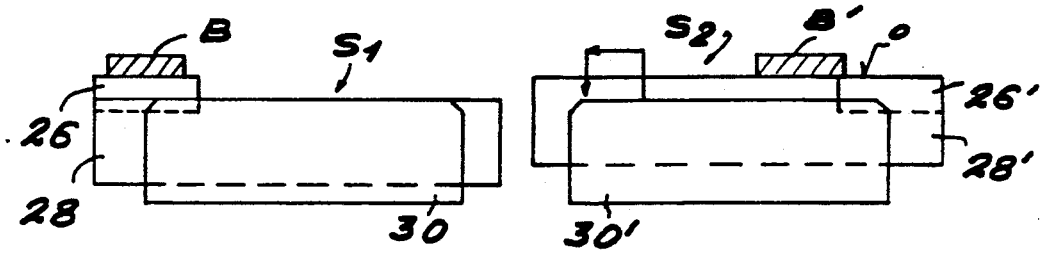

FIG. 11 shows the first phase of this storage operation. During this phase, movable beams 28 and 30, which correspond to the storage zone S1 of the products brought by the table with rollers 26, are held stationary so as not to interfere with the displacement of the product B which is conveyed normally on the rollers 26 of the table. The support beams 28' are raised up to the level 0 in the upper plane of the rollers 26' and then the transport beams 30' are displaced according to one or more rectangular cycles, in the manner already described above with reference to FIGS. 4 to 9, so as to bring the product B' into a storage position in the storage zone S2.

Figure 12:
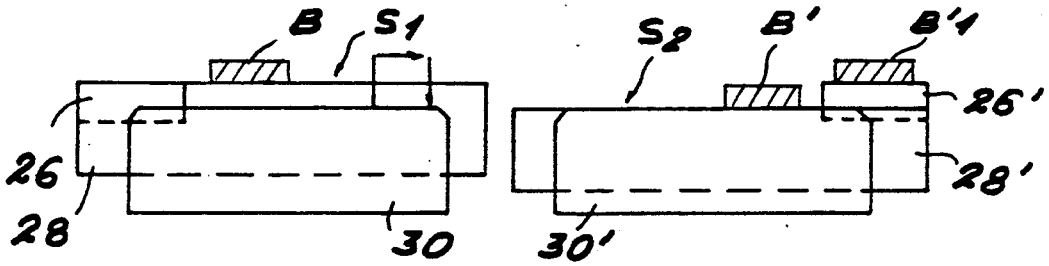

FIG. 12 now shows the loading of the product B in the storage zone S1. While this phase proceeds, the product B' remains stationary in its storage zone S2, the beams 28' and 30' not being displaced. The functioning of the table with rollers 26' makes it possible to convey a product B'1 normally through the storage furnace. In the manner already described above, a vertical displacement of the support beams 28, followed by one or more rectangular cycles of the transport beams 30, make it possible to bring the product B into the storage position in the zone S1, as illustrated in FIG. 12.

Figure 13:
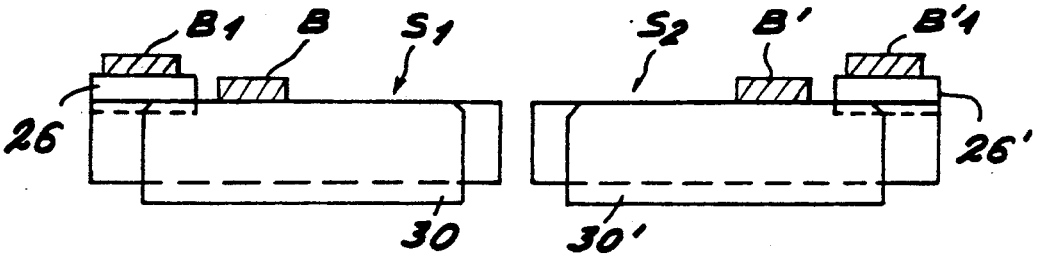

FIG. 13 shows the situation after the loading of the products B and B' in their respective storage zone S1 and S2, the tables with rollers 26, 26' ensuring a direct conveying of the products B1 and B'1 through the storage furnace.

Figure 14:
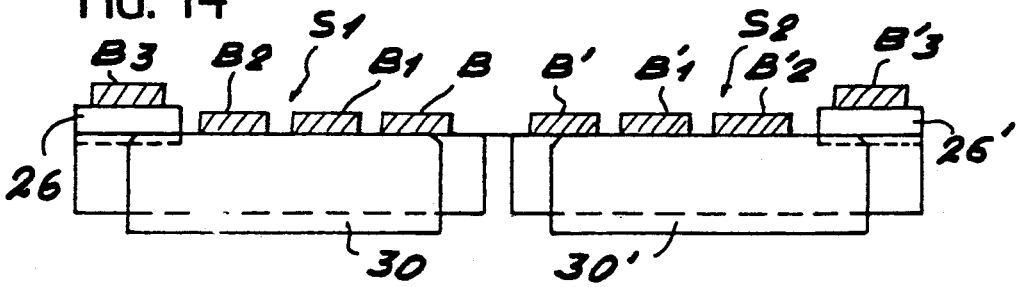

FIG. 14 is a diagram similar to FIG. 9, illustrating an example of maximum configuration of a storage of eight products. In this configuration, the storage zone S1 comprises four products B, B1, B2, B3, one B3 of which is supported by the table with rollers 26 and, similarly, the storage zone S2 comprises four products B', B'1, B'2, B'3, one B'3 of which is supported by the table with rollers 26'. It will be noted that it is possible to obtain any intermediate storage configuration ranging from 0 to 6 products in the storage zones S1, S2, plus a maximum of one or two products on the tables with rollers 26, 26'.

In this alternative embodiment, the removal of the products stored in the zones S1, S2 is performed in an identical manner to that described above with reference to FIGS. 4 to 9, but independently for each zone by virtue of two independent series of movable transport beams 30, 30'.

Figure 15:
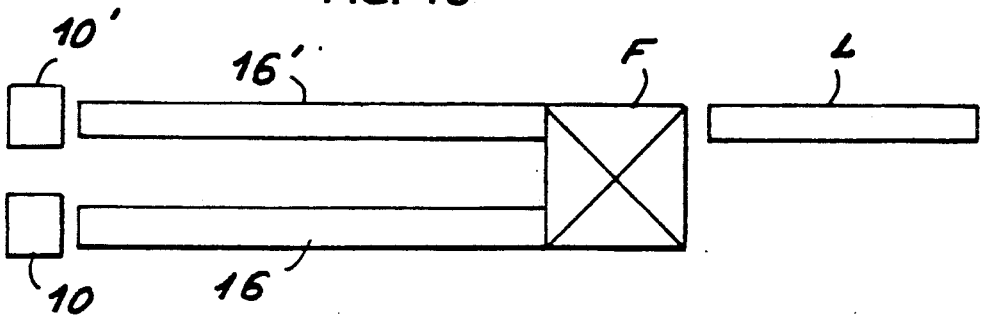
FIG. 15 is a diagrammatic plan view illustrating a second alternative embodiment of the installation which is the subject of the present invention.

The device which is the subject of the present invention may be installed at the outlet of the two furnaces 16, 16' (FIG. 1) so as to ensure the function of storage of these products in the event of a problem on the rolling line 20, but it may also be employed so as to ensure the transfer of the products of the two continuous casting lines towards the rolling line. This alternative embodiment of the invention is shown diagrammatically in FIG. 15. In this figure, the two continuous casting lines 10, 10' feed the furnaces 16, 16', respectively, at the outlet of which the storage and transfer furnace according to the invention, denoted by the reference F, is disposed, which feeds a rolling line denoted overall by the reference L.

Reference is now made to FIGS. 16 to 19 which illustrate the mode of functioning of this alternative embodiment according to the invention.

In this alternative embodiment, the means which ensure the displacement of the products towards the storage zone from the tables with rollers 26, 26' are identical to those described above with reference to FIGS. 1 to 9, that is to say they consist of movable support beams 28, 28' and transport beams 30 capable of being displaced in a rectangular movement.

Figure 16:
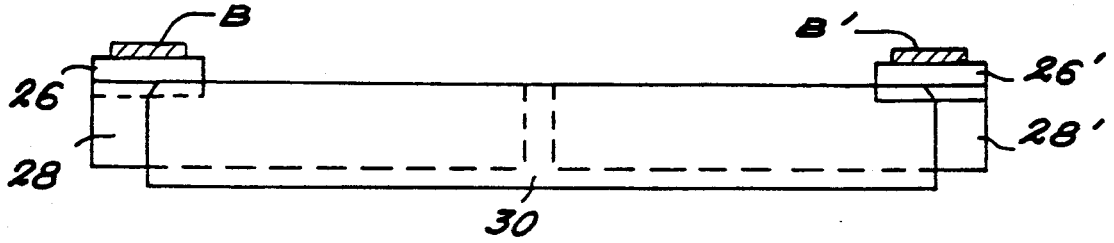
FIGS. 16 to 19 are also diagrammatic views, similar to FIGS. 4 to 9, and illustrate the method of implementation of this second alternative embodiment of the device which is the subject of the present invention.

FIG. 16 illustrates the initial situation. In this situation, a product B' originating from the continuous casting line 10, and from the furnace 16' is being removed on the rollers of the table with rollers 26' towards the rolling line L located along its axis. Simultaneously, the rollers of the table with rollers 26 can load another product B.

Figure 17:
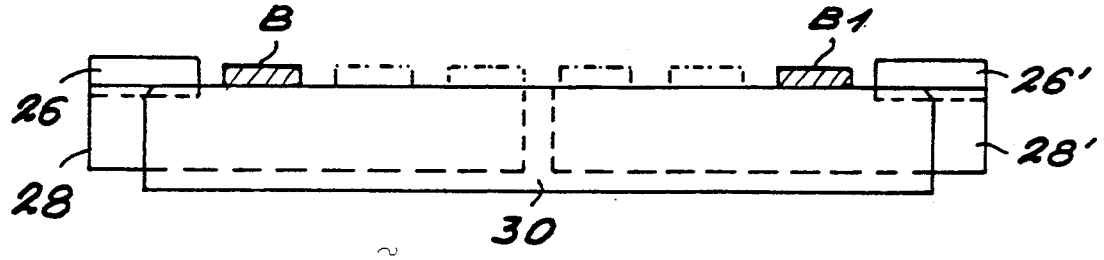

FIG. 17 illustrates the phase of transfer of the product B towards the rolling line. The rollers of the table with rollers 26' are free and the displacement of the movable beams 28, 28' and 30 make it possible to seize the product B on the rollers of the table with rollers 26 and to place it at the start of the storage zone. The repetition of several rectangular cycles of the transport beams 30, in the same manner as described above, makes it possible to displace the product B in order to bring it to the end of the storage zone opposite the table with rollers 26. In FIG. 17, the product B has been finally brought to the position B1, immediately in the vicinity of the table with rollers 26' which has remained free.

Figure 18:
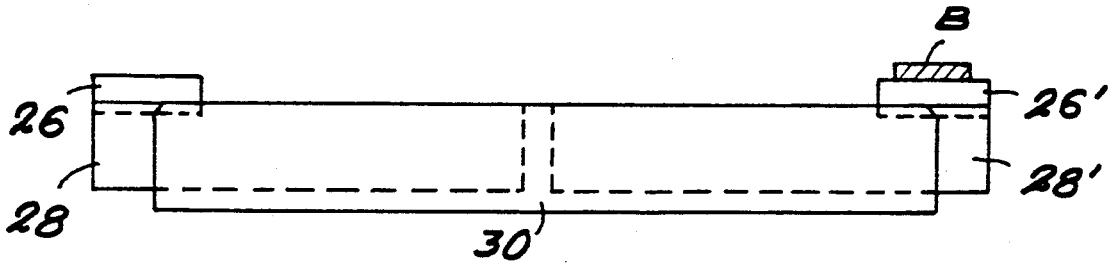

During the phase of functioning illustrated in FIG. 18, the product B is deposited on the rollers of the table with rollers 26' by virtue of the movement of the beams 28' and 30 so as then to be capable of being removed towards the rolling line L.

In this alternative embodiment of the invention, it is also possible, in the event of an incident on the rolling line L, to store the products as described above.

Figure 19:
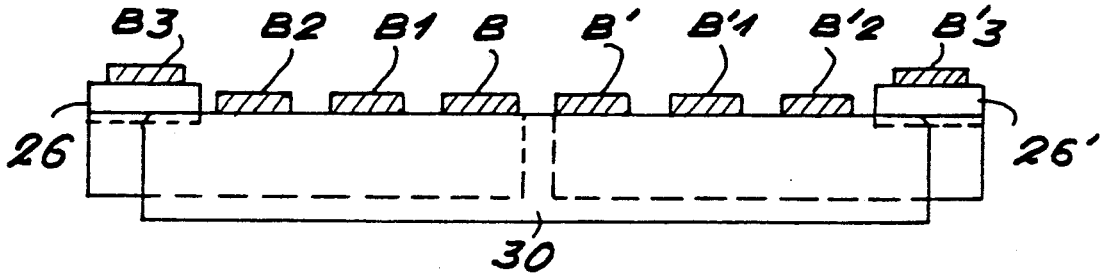

FIG. 19 shows this storage possibility and it illustrates an example of maximum storage capacity of eight products, according to a configuration similar to those illustrated in FIGS. 9 and 14. In this configuration, there are two lots of three products B, B1, B2 and B', B'1, B'2, respectively, in the storage zone and two products B3, B'3, respectively, on the tables with rollers 26, 26'. Removal from storage is performed in a manner similar to that described above, that is to say that this operation commences with the product B'3 located on the table with rollers 26', this product being removed directly towards the rolling line L, and then the subsequent successive products B'2, B'1, B', B, B1, B2, B3 are removed successively by the table with rollers 26' to which they are brought one after the other by the rectangular displacement cycles of the transport beams 30.

The advantages provided by the device according to the invention described above are, particularly, the following:

possibility of creating a storage zone in an installation without increasing the length thereof;

the storage capacity thus achieved makes it possible to ensure that continuous casting proceeds in the event of even a prolonged stoppage of the work on the rolling line;

the storage of the products is ensured in a chamber with a controlled temperature, which prevents any alteration of the temperature of the products stored or any modification in the distribution of the temperature;

after even a stoppage of long duration the rolling line, the conditions and the capacity of storage of the products make it possible to obtain a rapid restart of the rolling line;

the arrangement and the displacement of the movable beams make it possible to restrict the hot deformation of the products, even during stoppages of long duration, by varying the points of support of these products on the surface of the beams;

during normal functioning of the installation, that is to say in the absence of breakdowns or incidents on the rolling line, the circuit followed by the products is not disturbed by storage.

It remains perfectly understood that the present invention is not restricted to the various illustrative embodiments, implementation examples or examples of application described and mentioned above, but that it encompasses all the variations thereof.

I claim:

1. Apparatus for storing metallurgical products downstream of two parallel continuous casting lines functioning simultaneously and upstream of a rolling line, said apparatus comprising:

a heated storage chamber having a length at least equal to the length of said products, said storage chamber having opposed inlet and outlet openings for the products originating from said continuous casting lines and delivered to said rolling line;

a table positioned within said storage chamber on each side thereof and disposed along an axis of each of said continuous casting lines, said table having rollers for transporting said products through said storage chamber;

a storage zone in said chamber located between said tables and comprising a plurality of movable beams including support means which can be displaced vertically between a plurality of levels and transport beams, disposed parallel to and spaced from said support beams and capable of being displaced vertically and horizontally for causing said products to advance step-by-step in a series of successive rectangular movements, said beams being positioned successively between two rollers of each table so that said products from each casting line can be successively supported and displaced parallel to its axis by said movable beams in order to be deposited for storage between the tables.

2. Apparatus according to claim 1, wherein each of the rollers of said tables is driven from the outside of the storage chamber by means of a projecting shaft.

3. Apparatus according to claim 1 or 2, wherein the movable support beams are distributed in two identical series disposed in parallel in two locations of the storage zone, and wherein a single series of transport beams is provided, each transport beam of said series being positioned between two pairs of support beams of each location of the storage zone in order to ensure independent displacement of the products in one or the other of the storage locations.

4. Apparatus according to claim 1, adapted to ensure independent storage and removal of the products stored on each row of respective tables with rollers, each transport beam being divided into two independent parts to feed two independent storage zones.

5. A method of storing metallurgical products which originate from two parallel continuous casting lines and are conveyed to a rolling line comprising:

providing downstream from said casting lines and upstream from said rolling line a storage chamber having a storage zone and rollers for transporting said products through said storage chamber:

introducing each of said metallurgical products into said storage zone on said rollers;

lifting each of said metallurgical products from said rollers by a vertically movable support beam;

transferring each of said metallurgical products from said support beam to a vertically and horizontally movable transport beam; and advancing each of the metallurgical products on said transport beam into said storage zone step-by-step by a series of successive rectangular movements.

* * * * *